US006715633B2

(12) United States Patent
Thoms

(10) Patent No.: US 6,715,633 B2
(45) Date of Patent: Apr. 6, 2004

(54) INTERFOLDED SHEET DISPENSER HAVING A STARTER SHEET PULL-OUT SYSTEM

(75) Inventor: Craig M. Thoms, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/092,029

(22) Filed: Mar. 6, 2002

(65) Prior Publication Data

US 2003/0168467 A1 Sep. 11, 2003

(51) Int. Cl.[7] ..... B65H 3/00
(52) U.S. Cl. ..... 221/37; 221/210
(58) Field of Search ..... 221/33, 37, 45, 221/48, 50, 63, 210, 213; 206/449, 494, 812, 409, 804

(56) References Cited

U.S. PATENT DOCUMENTS

| | | | | |
|---|---|---|---|---|
| 2,269,039 A | | 1/1942 | Ross | |
| 3,276,622 A | * | 10/1966 | Krzyzanowski | 221/37 |
| 3,691,140 A | | 9/1972 | Silver | |
| 3,857,731 A | | 12/1974 | Merrill, Jr. et al. | |
| 3,868,052 A | | 2/1975 | Rockefeller | |
| 3,979,019 A | | 9/1976 | Bliss | |
| 4,166,152 A | | 8/1979 | Baker et al. | |
| 4,574,952 A | * | 3/1986 | Masui | 206/494 |
| 4,786,696 A | | 11/1988 | Bohnel | |
| 4,988,567 A | | 1/1991 | Delgado | |
| 4,994,322 A | | 2/1991 | Delgado et al. | |
| 5,045,569 A | | 9/1991 | Delgado | |
| 5,197,630 A | * | 3/1993 | Kirla | 221/37 |
| 5,542,568 A | * | 8/1996 | Julius | 221/63 |
| 6,268,032 B1 | | 7/2001 | Mertens et al. | |
| 6,419,114 B1 | | 7/2002 | Lenz et al. | |

FOREIGN PATENT DOCUMENTS

| | | |
|---|---|---|
| WO | WO9617794 A1 | 6/1996 |
| WO | WO0061458 A1 | 10/2000 |

OTHER PUBLICATIONS

PCT Search Report, Jun. 30, 2003.

* cited by examiner

*Primary Examiner*—Kenneth W. Noland
(74) *Attorney, Agent, or Firm*—Dority & Manning, P.A.

(57) ABSTRACT

A dispenser for dispensing interfolded disposable sheets is disclosed. The dispenser includes a removable top that is releasably attached to the first sheet in the stack contained in the container. In accordance with the present invention, when the removable top is pulled off the container, the first sheet in the stack is partially withdrawn from the container. After being partially withdrawn, however, the sheet releases from the removable top.

26 Claims, 2 Drawing Sheets

INTERFOLDED SHEET DISPENSER HAVING A STARTER SHEET PULL-OUT SYSTEM

BACKGROUND OF THE INVENTION

Disposable sheet style dispensers are well-known in the art for dispensing individual folded sheet products such as facial tissues, hand sheets, wet wipes, or the like. In general, disposable sheet dispensers typically include a container and a stack or clip of pre-folded, interfolded sheets disposed within the container. The sheets may be C-folded, V-folded, or flat so that once the top sheet in the clip is withdrawn, the underlying sheet is individually presented for subsequent use.

One of the common problems among disposable sheet dispensers involves the issue of "double pull". This occurs when more than one sheet comes out of the container when the leading sheet is withdrawn. Additionally, the problem of "streaming" can occur in disposable sheet dispensers. Streaming occurs when the user pulls the first sheet out, and subsequent sheets are also withdrawn, with the separation of the following ones never occurring.

To overcome some of these problems, disposable sheet dispensers have been designed where the dispensing slot is a slit. The use of slits has worked well in eliminating some of the above problems. Narrow slits are also well-suited to presenting tissue sheets for subsequent removal. In some applications, however, it is sometimes difficult to remove the initial sheet from the stack when a slit is present. For instance, the slit can interfere with the ability of a user to grab the leading edge.

In order to overcome some of these problems, in U.S. Pat. No. 4,574,952 to Masui, a box containing facial tissues is disclosed in which a tape or strings are attached to the undersurface of the top sheet of the box and, in turn, attached to the upper most of the facial tissues. In this manner, when the box is opened, and the top sheet is removed along a perforated line, the upper most facial tissue is automatically removed from the container along with the top sheet.

Although the top facial tissue is automatically removed from the box when the box is opened, the tissue may not be usable since it is attached to the removable top sheet of the box. Further, many times tissue boxes are opened for display purposes where a tissue is not initially needed. In these instances, removal of the first tissue by automatically opening the box can lead to waste of the leading sheet. In view of these drawbacks, the present invention is directed to further improvements in interfolded sheet dispensers.

SUMMARY OF THE INVENTION

In general, the present invention is directed to a dispenser for dispensing interfolded disposable sheets. A stack of interfolded disposable sheets are housed within a container. The sheets are arranged to be withdrawn from the container one after another. The sheets can be various paper products, including facial tissues, paper towels, industrial wipers, laboratory wipers, wet wipes, and the like. The dispensing container includes a removable panel that, once removed, uncovers an opening for withdrawing the sheets.

In accordance with the present invention, the removable panel is attached to a first sheet in the stack of interfolded sheets. In particular, the removable panel is attached to the first sheet such that when the removable panel is removed from the dispensing container, the first sheet is partially pulled through the opening of the dispensing container without being completely removed from the container.

An attachment device is used to attach the first sheet in the stack to the removable panel. The attachment device can be, for instance, a mechanical structure or an adhesive. In one embodiment, the attachment device is a strip of double-sided adhesive tape. For example, in one embodiment, the double-sided adhesive tape has a first side that is adhered to the removable panel and a second side that is adhered to the first sheet. In this embodiment, the first side can have a greater adhesive strength than the second side.

In one embodiment, the first sheet has a first end that is interfolded with another sheet in the stack. The second end of the sheet, however, is attached to the removable panel and is folded upon itself in an amount sufficient for the first sheet to be partially removed from the dispensing container when the removable panel is removed. In this manner, resistance to being removed from the container is increased as the first sheet is pulled through the opening by the removable panel.

The dispensing container can be made from various materials and is generally not critical to the present invention. For instance, the dispensing container can be made from paperboard or from a flexible polymer film. The dispensing container can be in the shape of a rectangular box, a square box, or in the form of any other suitable shape.

Other features and aspects of the present invention are discussed in greater detail below.

BRIEF DESCRIPTION OF THE DRAWINGS

An embodiment of the present invention is described by way of example with reference to the accompanying drawings, in which.

Figure 1:
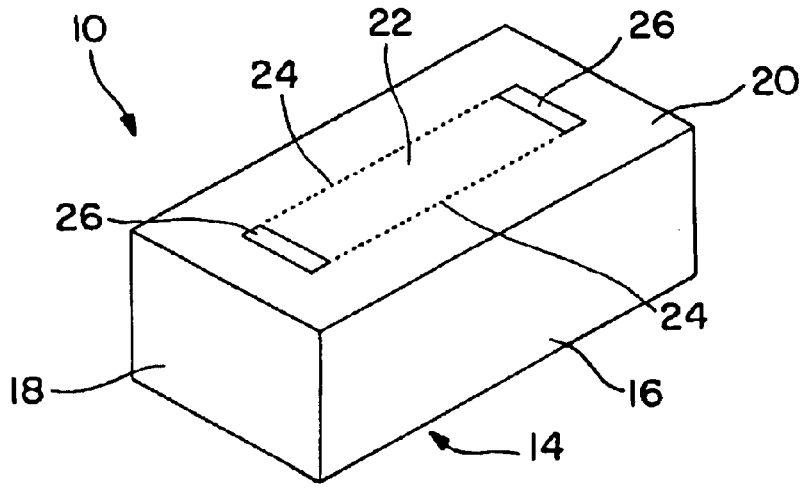
FIG. 1 is a perspective view of one embodiment of a dispenser made in accordance with the present invention.

Repeat use of reference characters in this present specification and drawings is intended to represent same or analogous features or elements.

DETAILED DESCRIPTION

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention includes these and other modifications and variations.

In general, the present invention is directed to a dispenser for dispensing interfolded disposable sheets. The disposable sheets can be, for instance, facial tissues, paper towels, industrial wipers, laboratory wipers, wet wipes, and the like. In accordance with the present invention, the dispensing container includes a removable panel that, once removed, uncovers an opening for withdrawing the sheets. The removable panel is releaseably attached to the first sheet in the stack contained within the dispensing container. In accordance with the present invention, the removable panel is attached to the first sheet in a manner such that when the panel is removed from the dispensing container, the first sheet is partially withdrawn. Once the sheet is partially withdrawn, the first sheet then detaches from the removable panel. In this manner, once the panel is removed from the container, the first sheet in the stack is available for easy and immediate removal.

The dispensing container of the present invention offers various advantages. For instance, the invention facilitates removal of the first sheet out of the dispensing container. Further, the first sheet is removed from the dispensing container without the risk of more than one sheet being withdrawn unnecessarily.

Referring to the figures, one embodiment of a dispensing container generally 10 is shown made in accordance with the present invention. The dispensing container 10 is for housing facial tissue in accordance with one embodiment of the present invention. It should be understood, however, that various other interfolded disposable sheets can be contained in a container made in accordance with the present invention.

Figure 4:
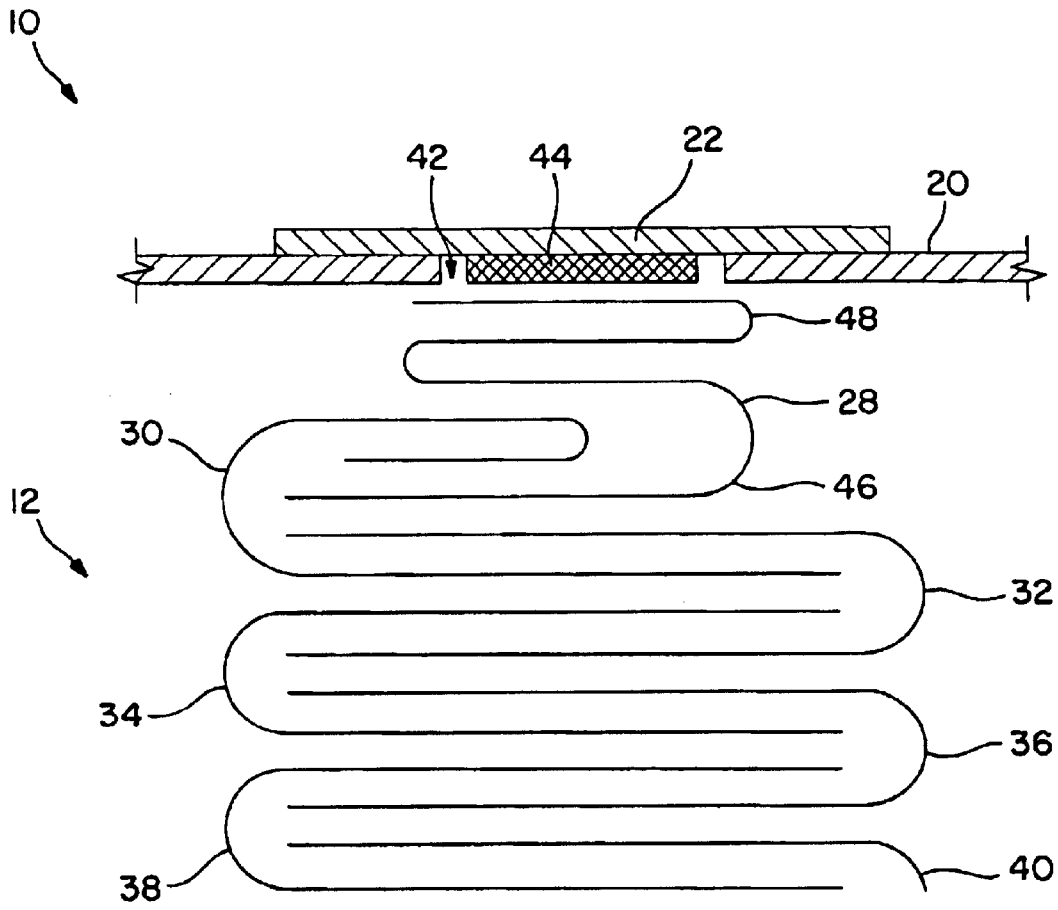
FIG. 4 is a cross-sectioned diagrammatical view of another embodiment of a dispenser made in accordance with the present invention.

Referring to FIG. 1 and FIG. 4, dispensing container 10 contains a clip of interfolded disposable sheets. The clip of interfolded disposable sheets 12 as shown particularly in FIG. 4 may be C-folded, V-folded, or configured with respect to one another by any means commonly known in the art.

As shown in FIG. 1, the dispensing container 10 includes a pair of sides or walls 16 that are contiguous with another pair of sides or walls 18. A support side or bottom wall 14 is present and is in contact with the walls 16 and 18. The interfolded sheets contained within the container generally rest upon the bottom wall 14 in this embodiment.

Also contiguous with the walls 16 and 18 is a dispensing wall or top wall 20. The top wall 20 includes a removable panel 22. Removable panel 22 includes end tabs 26 that are separated by lateral perforations 24. In this manner, a user is able to grasp either of the end tabs 26 and pull the panel along the perforations 24.

In general, the dispensing container 10 can be made from various materials. For instance, the container can be made from paperboard or cardboard. Alternatively, the container can be made from plastic films, such as thermoplastic films. Materials used to form the walls of the container can be rigid or flexible.

Referring to FIG. 4, a simplified cross-sectional view of the dispensing container 10 is shown. As illustrated, the container 10 includes the top wall 20 and the removable panel 22. In this embodiment, as opposed to the embodiment illustrated in FIG. 1, the removable panel 22 overlaps the top wall 20 and is not attached to the top wall via perforations. Instead, in this embodiment, the removable panel 22 can be removably adhered to the top wall.

As shown, below the top wall 20 is a stack of interfolded sheets generally 12. For purposes of illustration only, 7 interfolded sheets are illustrated, namely sheets 28, 30, 32, 34, 36, 38 and 40. The sheets are interfolded together and separated in the drawing for ease of explanation.

The removable panel 22 is positioned over an opening 42 in the top wall 20. Opening 42 is for withdrawing the sheets from the container after the panel 22 has been removed. In this embodiment, the removable panel further includes an attachment device 44. The attachment device 44 is for attaching the first sheet 28 to the removable panel 22. The attachment device 44 can be, for instance, an adhesive or a mechanical device that connects the first sheet to the panel.

In accordance with the present invention, the attachment device 44 is releaseably secured to the first sheet 28 contained within the interfolded stack. More particularly, the attachment device is designed to pull a portion of the top sheet 28 through the opening 42 when the removable panel 22 is removed from the container. After the sheet 28 has been partially withdrawn, however, the attachment device releases the sheet before the sheet is completely removed from the container. This is accomplished by selecting a particular attachment device 44, selecting a particular size of opening 42, and/or selecting a particular folding system for the stack of sheets 12.

Figure 2:
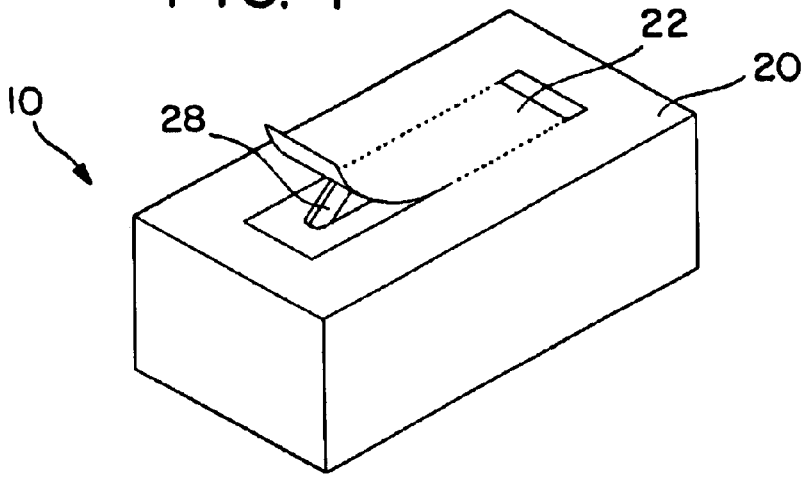
FIG. 2 is a perspective view of the dispenser illustrated in FIG. 1 showing the dispenser partially opened.
Figure 3:
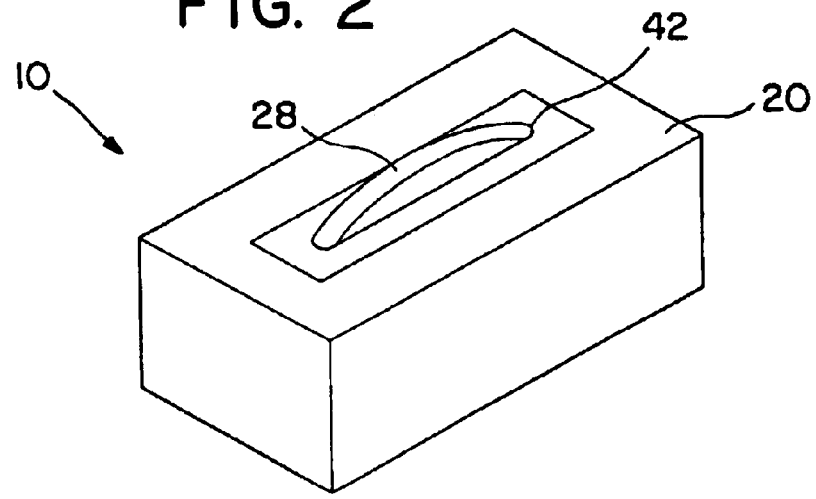
FIG. 3 is a perspective view of the dispenser illustrated in FIG. 1 showing the top panel of the dispenser removed exposing a sheet of material available to be withdrawn.

For example, referring to FIGS. 2 and 3, the dispensing container 10 is shown during and after the removable panel 22 has been pulled off the container. As shown, as the panel is removed from the container, the first sheet 28 is partially withdrawn through the opening 42. The sheet or tissue 28 is left exposed to initiate dispensing from the container 10.

Referring back to FIG. 4, one particular configuration of a folding system for the stack of sheets 12 in accordance with the present invention is illustrated. In this embodiment, the first sheet 28 includes a first end 46 and a second end 48. The first end of the sheet 28 is interfolded with the sheet 30. The second end 48 of the sheet 28, however, is folded upon itself. For instance, in this embodiment, the second end 48 is folded upon itself twice. It should be understood, however that further or less folds can be used as desired.

In addition to being folded upon itself, the second end 48 is also connected to the attachment device 44 which in turn is attached to the removable panel 22. In this manner, when the panel 22 is removed from the container, the second end 48 of the sheet 28 can be easily removed from the opening 42 without much resistance. Once the second end 48 is removed through the opening 42, however, resistance increases due to the sheet 28 being interfolded with the sheet 30 and/or due to the resistance of the sheet being pulled through the opening 42. This increased resistance is sufficient to release the second end 48 of the first sheet 28 from the attachment device 44, leaving the sheet 28 partially exposed.

The attachment device 44 used in the present invention can vary depending upon the particular application and the type of sheet material to be removed from the container. In general, the attachment device 44 must bind to the second end 48 of the sheet 28 an amount necessary to pull the second end of the sheet through the opening 42 but, yet be insufficient to be capable of pulling the entire sheet through the opening. In other words, an attachment device 44 is chosen in accordance with the present invention that will attach to the sheet 28 with an amount of force sufficient to pull a portion of the sheet through the opening but insufficient to overcome the force necessary to completely remove the first sheet from the container.

In one embodiment, for instance, the attachment device 44 is a pressure sensitive adhesive applied to the panel 22. The particular type of adhesive that can be used, will depend upon the type of sheets contained within the container and the construction of the container.

In one particular embodiment of the present invention, the attachment device is a two-sided adhesive tape. In this embodiment, the two-sided adhesive tape can include a first side that is attached to the removable panel 22 and a second side that is attached to the second end of the sheet 28. The first side of the double-sided tape can have a greater adhesive force than the second side to allow for the sheet 28 to be released from the removable panel 22 after the sheet has been partially withdrawn from the opening 42.

In this embodiment of the present invention, the adhesive that is used to attach the double-sided tape to the removable panel 22 can be any of many suitable adhesives with permanent adherence characteristics. The second side of the tape, however, can contain a releasable adhesive, such as the adhesives used on POST-IT notes marketed by the 3M Corporation of St. Paul, Minn. Such adhesives are disclosed in U.S. Pat. Nos. 5,045,569; 4,988,567; 4,994,322; 4,786,696; 4,166,152; 3,857,731; and 3,691,140, which are all incorporated herein reference. For example, the pressure sensitive adhesive can comprise polymeric microspheres having an average diameter of at least 1 micrometer. The microspheres can include about 70 parts by weight of an alkyl acrylate or alkyl methacrylate ester. Such adhesives can be formulated to have a particular peel adhesion for use in the present invention.

In addition to the use of adhesives, the attachment device 44 can also be a mechanical attachment structure. Examples of mechanical attachment structures include, for instance, breakaway strings, staples, pins, or other grasping type devices that can releasably attach to an interfolded disposable sheet.

In addition to the attachment device selected in the present invention and the folding system used to interfold the sheets, the size and construction of the opening 42 in the removable panel 22 can also be used to assist in carrying out the objectives of the present invention. In particular, the opening 42 can be designed to increase the resistance placed on the sheet 28 as it is withdrawn from the container for facilitating release between the sheet 28 and the removable panel 22.

In general, however, an enlarged slot or opening is used in the top wall 20 of the container to allow the attachment device 44 to adhere to the first sheet 28. For example, in one embodiment, when designing a tissue dispenser, the opening can be approximately 5 to about 6 inches long and can be approximately ½ to about ¾ inches wide. In this embodiment, the attachment device can be an adhesive strip that is approximately ½ inch wide and can be placed generally in the center of the removable panel 22. It should be understood, however, that many other dimensions and variations can be used in the present invention.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A dispenser for dispensing interfolded disposable sheets comprising:

a dispensing container housing a stack of interfolded disposable sheets that are to be withdrawn one after another, the dispensing container including a removable panel that, once removed, uncovers an opening for withdrawing the sheets, the removable panel being configured to be completely removed and separated from the dispensing container, the removable panel being attached to a first sheet in the stack of interfolded sheets, wherein, when the removable panel is removed and separated from the dispensing container, the first sheet is partially pulled through the opening of the dispensing container without being completely removed from the container.

2. A dispenser as defined in claim 1, wherein the opening comprises a slit.

3. A dispenser as defined in claim 1, wherein the first sheet has a first end and second end, the second end being interfolded with another sheet in the stack, the first end being attached to the removable panel and being folded upon itself in an amount sufficient for the first sheet to be partially removed from the dispensing container when the removable panel is removed.

4. A dispenser as defined in claim 3, wherein the first end of the first sheet is folded upon itself at least twice.

5. A dispenser as defined in claim 1, wherein the first sheet is mechanically attached to the removable panel.

6. A dispenser as defined in claim 1, wherein the first sheet is adhesively attached to the removable panel.

7. A dispenser as defined in claim 1, further comprising a strip of double-sided adhesive tape that attaches the first sheet to the removable panel.

8. A dispenser as defined in claim 7, wherein the double-sided adhesive tape has a first side and second side, the first side being adhered to the removable panel, the second side being adhered to the first sheet, the first side having a greater adhesive strength than the second side.

9. A dispenser as defined in claim 1, wherein the stack of interfolded disposable sheets comprise facial tissues.

10. A dispenser as defined in claim 1, wherein the dispensing container is in the shape of a rectangular box.

11. A dispenser as defined in claim 1, wherein the dispensing container is in the shape of a square box.

12. A dispenser as defined in claim 1, wherein the removable panel is surrounded by perforations that attach the panel to the dispensing container.

13. A dispenser as defined in claim 1, wherein the dispensing container is made from paperboard.

14. A dispenser as defined in claim 1, wherein the dispensing container is made from a flexible polymer film.

15. A dispenser as defined in claim 1, wherein the stack of interfolded disposable sheets comprise wet-wipes.

16. A tissue dispenser for dispensing interfolded disposable facial tissues comprising:

a dispensing container housing a stack of interfolded disposable facial tissues that are to be withdrawn one after another, the dispensing container including a removable panel that, once removed, uncovers an opening for withdrawing the facial tissues, the removable panel being configured to be completely removed and separated from the dispensing container, the stack of facial tissues including a first tissue that has a first end and a second end, the second end being interfolded with another tissue in the stack, the first end being attached to the removable panel, wherein, when the removable panel is removed and separated from the dispensing container, the first facial tissue is partially pulled through the opening of the dispensing container and then released from the removable panel without being completely removed from the container.

17. A dispenser as defined in claim 16, wherein the first end of the first facial tissue is folded upon itself at least twice.

18. A dispenser as defined in claim 16, wherein the removable panel is mechanically attached to the first facial tissue.

19. A dispenser as defined in claim 16, wherein the removable panel is adhesively attached to the first facial tissue.

20. A dispenser as defined in claim 16, further comprising a strip of double-sided adhesive tape that attaches the first facial tissue to the removable panel.

21. A dispenser as defined in claim 20, wherein the double-sided adhesive tape has a first side and second side, the first side being adhered to the removable panel, the second side being adhered to the first facial tissue, the first side having a greater adhesive strength than the second side.

22. A dispenser as defined in claim 21, wherein the double-sided adhesive tape has a length and a width that are less than the length and the width of the removable panel, the double-sided adhesive tape being located approximately in the center of the removable panel.

23. A method for dispensing interfolded disposable sheets comprising the steps of:

providing a dispensing container housing a stack of interfolded disposable sheets, the dispensing container including a removable panel that, once removed, uncovers an opening for withdrawing the sheets, the removable panel being attached to a first sheet in the stack of interfolded sheets; and removing the removable panel from the dispensing container causing the first sheet to be partially removed from the dispensing container through the opening, wherein, once the first sheet is partially removed from the dispensing container, the first sheet is released from the removable panel in that the force necessary to separate the first sheet from the stack of interfolded sheets is greater than the force necessary to separate the first sheet from the removable panel.

24. A dispenser for dispensing interfolded disposable sheets comprising:

a dispensing container housing a stack of interfolded disposable sheets that are to be withdrawn one after another, the dispensing container including a removable panel that, once removed, uncovers an opening for withdrawing the sheets, the removable panel being attached to a first sheet in the stack of interfolded sheets, the first sheet having a first end and a second end, the second end being interfolded with another sheet in the stack, the first end being attached to the removable panel and being folded upon itself in an amount sufficient for the first sheet to partially removed from the dispensing container when the removable panel is removed, and wherein, when the removable panel is removed from the dispensing container, the first sheet is partially pulled through the opening of the dispensing container without being completely removed from the container.

25. A dispenser as defined in claim 24, wherein the first end of the first sheet is folded upon itself at least twice.

26. A dispenser for dispensing interfolded disposable sheets comprising:

a dispensing container housing a stack of interfolded disposable sheets that are to be withdrawn one after another, the dispending container including a removable panel that, once removed, uncovers an opening for withdrawing the sheets, the removable panel being attached to a first sheet in the stack of interfolded sheets by a strip of double-sided adhesive tape, the double-sided adhesive tape having a first side and a second side, the first side being adhered to the removable panel, the second side being adhered to the first sheet, the first side having a greater adhesive strength than the second side, and wherein, when the removable panel is removed from the dispensing container, the first sheet is partially pulled through the opening of the dispensing container without being completely removed from the container.

* * * * *

UNITED STATES PATENT AND TRADEMARK OFFICE

CERTIFICATE OF CORRECTION

PATENT NO. : 6,715,633 B2
APPLICATION NO. : 10/092029
DATED : April 6, 2004
INVENTOR(S) : Craig M. Thoms It is certified that error appears in the above-identified patent and that said Letters Patent is hereby corrected as shown below:

Column 8, line 6 “to partially removed” should read --to be partially removed--

Column 8, line 19 “dispending” should read --dispensing--

Signed and Sealed this

Eighth Day of December, 2009

David J. Kappos

David J. Kappos
*Director of the United States Patent and Trademark Office*